United States Patent [19]

Tanaka et al.

[11] Patent Number: 4,565,361

[45] Date of Patent: Jan. 21, 1986

[54] BANK NOTE DISPENSER

[75] Inventors: Masaru Tanaka, Yokohama; Hideo Abe, Tokyo, both of Japan

[73] Assignee: Fuji Giken Kabushiki Kaisha, Kawasaki, Japan

[21] Appl. No.: 598,792

[22] Filed: Apr. 10, 1984

[30] Foreign Application Priority Data

Apr. 11, 1983 [JP] Japan ..... 58-62327

[51] Int. Cl.[4] ..... B65H 7/08

[52] U.S. Cl. ..... 271/10; 271/110; 271/114; 271/121; 271/258; 271/265

[58] Field of Search ..... 271/110, 111, 114, 119, 271/121, 258, 259, 265, 10

[56] References Cited

U.S. PATENT DOCUMENTS 3,981,493 9/1976 Klappenecker ..... 271/111 X

OTHER PUBLICATIONS

IBM Technical Disclosure Bulletin, vol. 18, No. 2, pp. 330, 331, Jul. 1975, "Dynamic Sheet Length Sensing", W. E. Church et al.

*Primary Examiner*—Richard A. Schacher

*Attorney, Agent, or Firm*—Wenderoth, Lind & Ponack

[57] ABSTRACT

The bank notes in a bank note container are delivered one at a time by means of feed rollers and a delivery roller. The delivered bank notes are detected by sensor means. A signal from the sensor means is transferred to a control mechanism which drives or stops the delivery roller. The delivery roller is stopped and is driven again in response to a signal from an encoder carried by a supporting shaft of pull rollers. Therefore the bank notes are delivered from the bank note delivery container to the outside thereof in a predeterminedly spaced apart relationship.

5 Claims, 4 Drawing Figures

BANK NOTE DISPENSER

BACKGROUND OF THE INVENTION

The present invention relates to generally a bank note dispenser of the type for dispensing or delivering a predetermined number of bank notes from a cartridge type bank note container and more particularly a bank note dispenser in which a bank note delivered from the bank note container can be smoothly pulled out by pull rollers.

In general, in banks or the like, in order to deliver a predetermined number of bank notes to a client or a teller, bank note dispensers have been used. The bank note dispensers of this type have a plurality of cartridge type bank note containers detachably mounted therein. When the bank note containers are set into the main body of a bank note dispenser, a predetermined number of bank notes can be delivered or dispensed one at a time.

In the conventional bank note dispensers, bank notes are delivered out of the bank note containers by means of delivery rollers disposed therein and the delivered bank notes are pulled by pull rollers and delivered to the exterior of the bank note dispenser. However, in order to count the number of delivered bank notes, they must be spaced apart from each other by a predetermined distance. For this purpose, the rotational speed of the pull rollers are about twice as high as the delivery velocity of the delivery rollers. In this case, when each delivered bank note is clamped and pulled by the pull rollers, the delivery speed of the bank note is changed rapidly. As a result, noise is produced and the delivered bank note is torn.

SUMMARY OF THE INVENTION

In view of the above, the primary object of the present invention is to provide a bank note dispenser in which the pulling velocity of pull rollers is substantially the same as the delivery velocity of a delivery roller so that noise and tearing of a bank note caused by the bank note being pulled by the pull rollers can be positively prevented.

According to this invention, there is provided a bank note dispenser in which bank note containers are mounted in the main body of the bank note dispenser; feed rollers for feeding the bank notes contained in each bank note container and a delivery roller for delivering a bank note out of each bank note container are disposed within each bank note container; a bank note delivered from the delivery roller is pulled by pull rollers; the pulling velocity of the pull rollers is substantially the same as the delivery velocity of the delivery roller; a mechanism for controlling the rotation of the delivery roller is carried by a supporting shaft which in turn rotatably supports the delivery roller; the control mechanism is operatively coupled to sensor means disposed on the upstream side of the pull rollers in a bank note passage and to an encoder carried by a shaft of one of the pull rollers; and the control mechanism is controlled in response to the signals from the sensor means and encoder.

The above and other objects, effects, features and advantages of the present invention will become more apparent from the description of a preferred embodiment thereof taken in conjunction with the accompanying drawings.

DETAILED DESCRIPTION OF THE INVENTION

Figure 1:
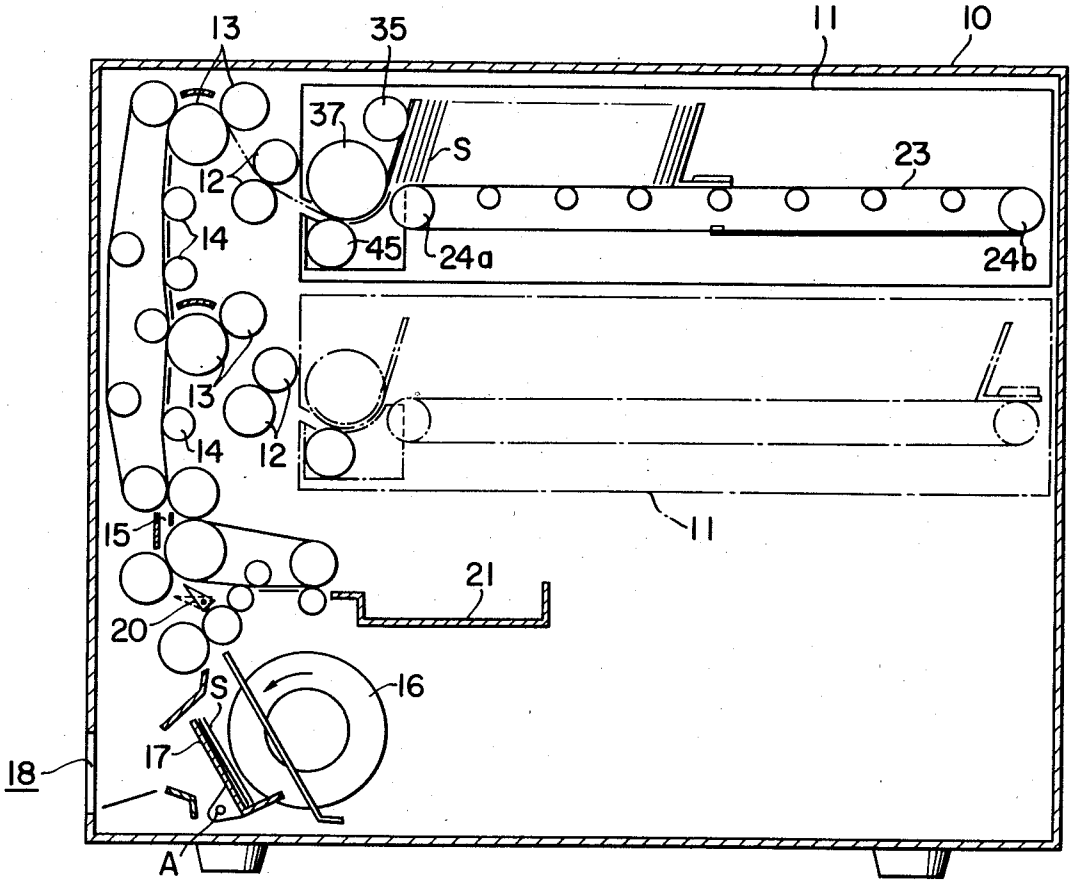
FIG. 1 is a schematic side elevational view, in vertical section, showing the construction of a bank note dispenser in accordance with the present invention.

Referring first to FIG. 1, reference numeral 10 designates a main body of a bank note dispenser and a bank note container 11 is detachably mounted in the main body 10. For instance, a plurality of bank note containers 11 are vertically disposed in the main body 10. For instance, two bank note containers 11 are stacked in the main body 10. As will be described in detail below, each bank note container 11 contains a plurality of bank notes and is adapted to discharge the bank notes one at a time when a control panel (not shown) is operated.

A bank note discharged from the bank note container 11 is pulled by a pair of pull rollers 12 and is guided through a bank note passage 15 defined by guide rolls 13 and 14 toward a stacker 17 through a vane wheel 16. When a predetermined number of bank notes S are stacked on the stacker 17, the stacker 17 is rotated about a pivot point A so that the bank notes can be taken through a discharge or dispenser opening 18.

The bank note passage 15 includes a gate 20 which is adapted to swingably move between a normal position and a discharge position. When a sensor (not shown) detects abnormally discharged bank notes such as two consecutively discharged or overlapped bank notes or bank notes broken or cut into halves, the gate 20 swings to the discharge position indicated by one-dot chain lines so that the bank note or notes S which are being guided through the bank note passage 15 are directed toward the discharge side so as to be received by a discharged bank note receiver 21.

Figure 2:
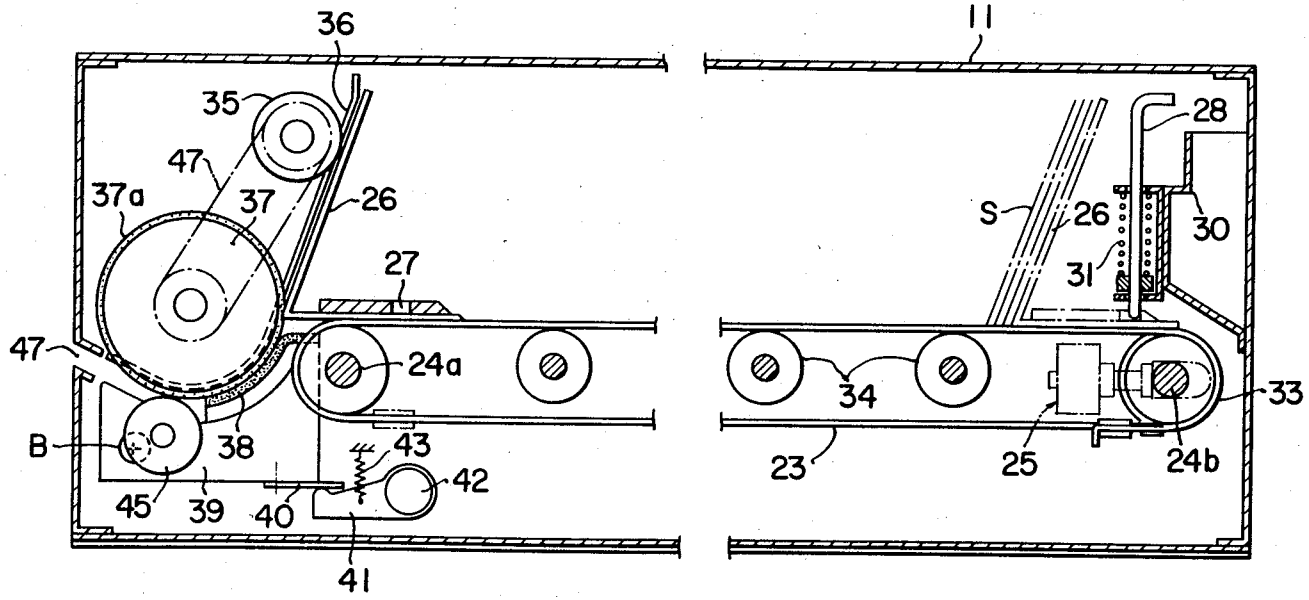
FIG. 2 is a schematic side elevational view, in vertical section, of a cartridge type bank note container which is incorporated in the bank note dispenser.

As shown in FIG. 2, the bank note container 11 is in the form of an enclosed casing and contains an endless belt 23. The endless belt 23 horizontally runs between roller shafts **24*a* and 24*b* and tension exerted to the endless belt 23 can be adjusted by a tension adjusting device 25 which causes the shift of the position of the roller shaft 24*b*. A press body 26 in the form of a plate is mounted on the upper run of the endless belt 23. The base portion of the press body 26 is attached to the endless belt 23. There is provided a lock pin 28 which is engageable with an engaging hole 27 formed at the base portion of the press body 26. The lock pin 28 is attached to a mounting bracket 30 which in turn is securely fixed to the bank note container 11 and is normally biased downwardly under the force of a spring 31**.

A helical leaf spring 33 as a spring biasing means is provided around the roller shaft **24*b*. One end of the leaf spring 33 is securely fixed to the endless belt 23 so that the endless belt 23 is biased in the counterclockwise direction in FIG. 2. The endless belt 23 is guided by a plurality of equidistantly spaced apart guide rollers 34 and a plurality of bank notes S are arranged in an array in the longitudinal direction upon the endless belt 23. The rear end of a group of the bank notes S is pressed forwardly by means of the press body 26**.

A feed roller 35 is disposed at the front end of the endless belt 23 and forms an eccentric roller. The feed roller 35 is adapted to be brought into a frictional contact with the forwardmost bank note of the bank note array. Upon rotation of the feed roller 35, a frictional force is exerted to the forwardmost bank note. Since the feed roller 35 is eccentric, the frictional force varies. That is, when a greater frictional force is exerted to the forwardmost bank note S, the bank note S is moved through a guide rail 36 to a delivery roller 37.

The deliver roller 37 exerts a greater frictional force to the bank note S so that a friction plate 37*a* made of a rubber or the like is mounted around the periphery of the delivery roller 37. An arcuate rubber plate 38 is brought into frictional contact with the delivery roller 37. The rubber plate 38 is mounted on a frame 39 so as to be swingable about a pivotal point B. An engaging lever 40 is fixedly disposed at the bottom portion of the frame 39 and engages with the free end of a clutch arm 41. The clutch arm 41 is carried by a one-way clutch shaft 42 and is normally biased upwardly under the force of a spring 43. As a result, the rubber plate 38 which is mounted on the frame 39 is pressed against the delivery roller 37. Therefore the rubber plate 38 is brought into intimate contact with the delivery roller 37 so that the delivery of overlapped bank notes S can be prevented.

Figure 3:
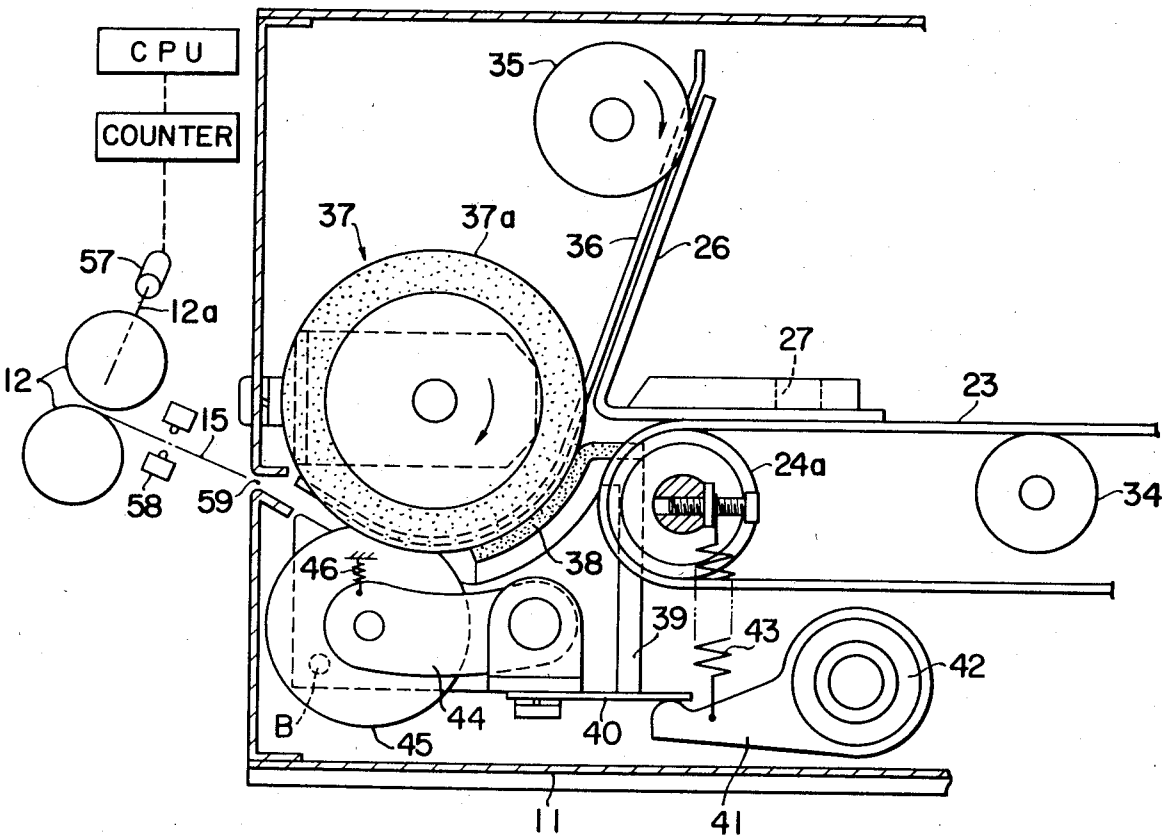
FIG. 3 is a schematic side elevational view, in vertical section, showing the relative positions of the front portion of the bank note container and pull rollers.

As shown in FIG. 3, a swingable arm 44 is mounted on the frame 39 and a pressure roller 45 is rotatably carried at the free end of the swingable arm 44. The swingable arm 44 is so biased under the force of a spring 46 that the pressure roller 45 is normally pressed against the delivery roller 37.

Figure 4:
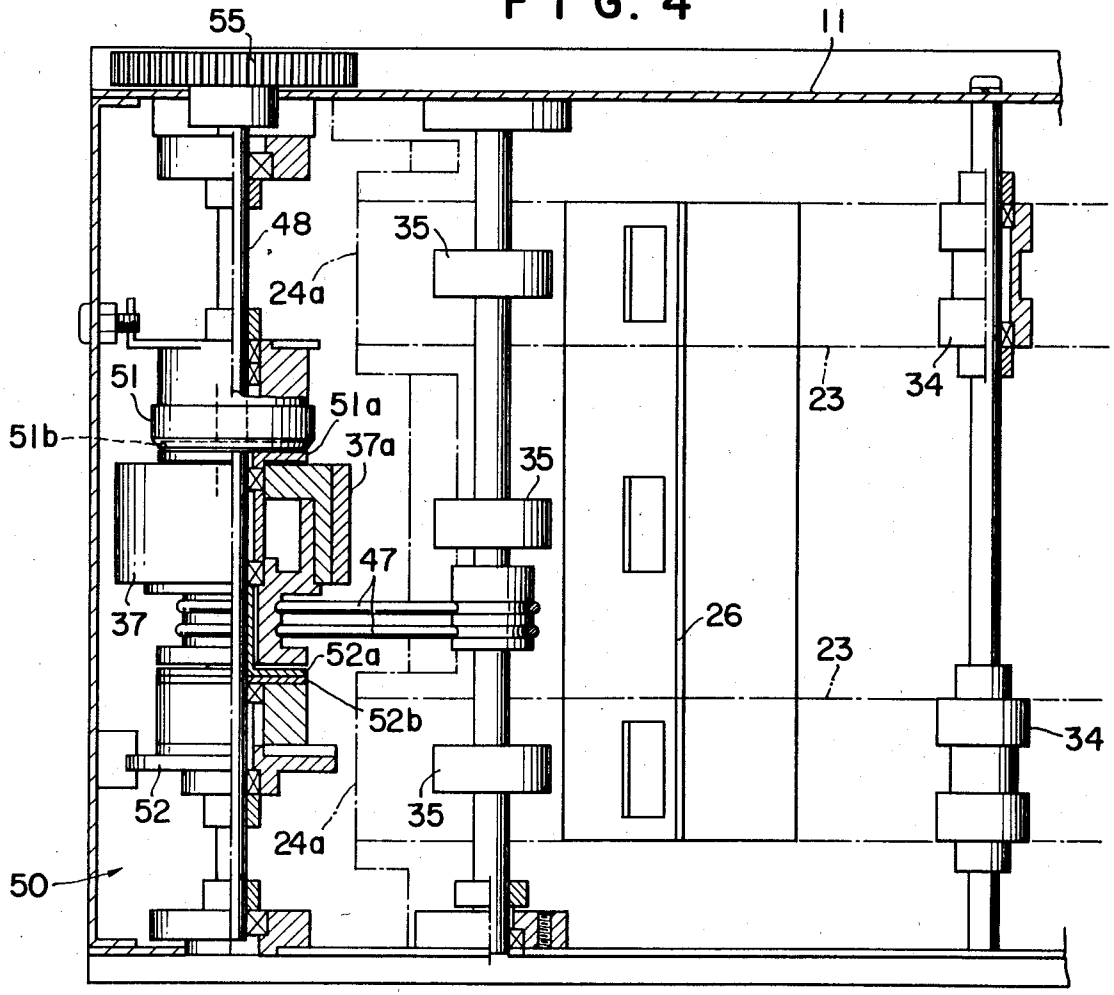
FIG. 4 is a schematic top view showing the front portion of the bank note container.

As shown in FIG. 4, the delivery roller 37 is coupled to the feed rollers 35 through belts 47 so that the delivery roller 37 and the feed rollers 35 are simultaneously driven. A supporting shaft 48 which carries the delivery roller 37 also carries a control mechanism 50 which controls to start or stop the delivery roller 37. The control mechanism 50 comprises a clutch mechanism comprising an electromagnetic clutch 51 and a brake device 52 for stopping the rotation of the delivery roller 37. The brake device 52 is an electromagnetic brake and when the brake device 52 is operated, the rotation of the delivery roller 37 is stopped.

That is, the brake device 52 rotates in unison with the delivery roller 37 and has a brake disk 52*a* which is movable in the axial direction. When the brake disk 52*a* is attracted by an attraction disk 52*b* of the brake device 52, the rotation of the delivery roller 37 is stopped. The delivery roller 37 is rotatably carried by the supporting shaft 48. Within the electromagnetic clutch 51 there is provided an attraction disk 51*b* which is carried by the supporting shaft 48. When a clutch disk 51*a* adapted to rotate in unison with the delivery roller 37 and movable in the axial direction is attracted by the attraction disk 51*b*, the rotation of the delivery roller 37 is initiated. One end of the supporting shaft 48 is extended through a side wall of the bank note container 11 to hold a follower gear 55 which is coupled to a driving source (not shown) through a driving gear (not shown) so that the follower gear 55 is driven.

The above described driving source is also coupled to the pull rollers 12 so that the pull rollers 12 are driven (see FIG. 3). There is provided an adjusting mechanism such as a gear train which is not shown in order that the pulling velocity of the pull rollers 12 becomes substantially equal to the delivery velocity of the delivery roller 37. A supporting shaft 12*a* which carries one of the pull rollers 12 also carries an encoder 57 which is adapted to generate the pulse signals corresponding to the number of rotations of the pull roller 12. The encoder 57 is operatively coupled to the clutch mechanism 51 and the brake device 52 through a central processing unit to be referred as a CPU so as to control them.

A conventional sensor 58 such as a photoelectric tube is disposed on the upstream side of the pull rollers 12 in the bank note passage 15. The sensor 58 is interposed between the pull rollers 12 and a bank note delivery opening 59 to detect the passage of a bank note so as to control the brake device 52. In this case, the distance between the delivery roller 37 and the sensor 58 and the distance between the sensor 58 and the pull rollers 12 are suitably determined depending upon the size of the bank notes.

The magnetic clutch 51 and the magnetic brake 52 are controlled by the encoder 57 and the sensor 58 in the following manner. Upon detection by the sensor 58 of a bank note S delivered from the bank note delivery opening 59 of the bank note container 11, the magnetic brake 52 is energized in response to the output from the sensor 58. That is, the brake disk 52*a* is attracted by the attraction disk 52*b* while the magnetic clutch 51 is activated so that the clutch disk 51*a* is released from the attraction disk 51*b*. As a result, the rotation of the supporting shaft 48 is not transmitted to the delivery roller 37, whereby the rotation of the delivery roller 37 is stopped. When the rotation of the delivery roller 37 is stopped, the rotation of the feed rollers 35 is also stopped so that the delivery of the bank notes in the bank note container 11 is interrupted. Since the sensor 58 is normally disposed adjacent to the pull rollers 12, even when the sensor 58 detects a bank note, the rotation of the delivery roller 37 cannot be immediately stopped because of the inertia of the delivery roller 37. That is, after the bank note has been delivered to the pull rollers 12, the delivery roller 37 is stopped.

The output signal indicating the passage of a bank note from the sensor 58 is transferred to the CPU and a counter starts counting the number of pulses generated by the encoder 57. When the counter has counted a predetermined number of pulses previously set in the CPU, the rotation of the delivery roller 37 is initiated again. That is, the magnetic clutch 51 and the magnetic brake 52 are operatively coupled to the encoder 57 and the sensor 58 through the CPU so that the magnetic clutch 51 and the magnetic brake 52 are controlled by the sensor 58 and the encoder 57. When the counter has counted a predetermined number of pulses generated from the encoder, the clutch disk 51*a* is attracted toward the attraction disk 51 while the brake disk 52*a* is released from the attraction disk 52*b*. The predetermined number of pulses counted by the counter corresponds to a distance between two adjacent bank notes which is long enough to count the number of bank notes. As a consequence, the delivery roller 37 is driven again. In synchronism with the rotation of the delivery roller 37, the feed rollers 35 are also driven so that a bank note which is contained in the bank note container 11 is delivered from the delivery opening 59 and is pulled by the pull rollers 12. As described above, as the pulling velocity of the pull rollers 12 is equal to the delivery velocity of the delivery roller, the bank note is smoothly pulled by the pull rollers 12 and guided. As a result, noise caused by the bank note being pulled and the tearing of the bank note caused by the bank note being pulled by the pull rollers 12 can be avoided. The distance between the successively delivered bank notes is suitably controlled by the energization or de-energization of the delivery roller 37 so that the number of delivered bank notes can be correctly counted.

Next, the operation of this invention will be explained.

A predetermined number (for instance, 3000) of bank notes S are arranged in an array over the endless belt 23 in the bank note container 11. That is, the bank notes are contained in the bank note container 11, which is closed and then mounted in the main body 10 of the bank note dispenser. Now it is ready to deliver bank notes. In this case, the lock pin 28 is pulled out of the engaging hole 27 of the press body 26 so that the press body 26 is in a free state.

When a desirable number of bank notes are dispensed, the control panel (not shown) which is disposed at the front side of the bank note disperser is suitably operated. Then the delivery roller 37 and the feed rollers 35 are simultaneously driven. The forwardmost bank note S which is in contact with the feed rollers 35 is delivered toward the delivery roller 37 because of the frictional forces produced upon rotation of the feed rollers 35. The delivered bank note S is prevented from being overlapped or superimposed one upon another by means of the rubber plate 38 which is brought into contact with the delivery roller 37. Thereafter the bank note S delivered from the delivery roller 37 is fed to the outside of the container 11 through the pressure roller 45 and the delivery opening 59 and is pulled and guided by the pull rollers 12.

The delivered bank note S is clamped between the pull rollers 12 to be pulled and guided. In this case, under the control of the control mechanism 50 described above, the bank notes S are spaced apart from each other by a predetermined distance so that it is not required to speed up the rotation of the pull rollers 12 so as to increase the distance between the adjacent bank notes S. Thereafter the bank note is moved along the bank note passage 15 by means of the guide rollers 13 and 14. While the bank note is being transported along the bank note passage 15, the abnormally discharged bank notes S are checked and directed by the gate 20 toward the abnormally discharged bank note receiver 21.

The normally discharged bank note S passes the gate 20 and is transported through the vane wheel 16 to the stacker 17 where the discharged bank notes are stacked. When a predetermined number of bank notes S are stacked on the stacker 17, the stacker 17 is rotated so that the bank notes can be easily taken out of the delivery opening 18.

In the above example, the control mechanism which controls the delivery roller 37 comprises a clutch mechanism and a brake device. However, it is to be understood that the control mechanism may comprise a pulse motor.

As described above, in the bank note dispenser in accordance with the present invention, the pulling velocity of the pull rollers is substantially equal to the delivery velocity of the delivery roller. As a result, even when the bank note delivered from the delivery roller is pulled by the pull rollers, the bank note can be smoothly pulled and guided by the pull rollers because there is no difference in velocity between them. As a consequence, noise and tearing of a bank note caused by the bank note being pulled by the pull rollers can be avoided.

Furthermore, the energization and de-energization of the delivery roller are controlled by the control mechanism which in turn is controlled by the sensor which detects the passage of a bank note and by the encoder carried by the shaft of the pull roller. As a result, the delivery roller is intermittently driven. Because of the intermittent driving of the delivery roller, the distance between the bank notes delivered from the delivery roller is suitably adjusted so that the number of bank notes transported through the bank note passage can be correctly counted.

What is claimed is:

1. A bank note dispenser for delivering a desirable number of bank notes from a bank note container mounted in a main body thereof comprising: feed rollers for delivering bank notes in the bank note container one at a time; a delivery roller for delivering each bank note delivered from the feed rollers into a bank note delivery passage; pull rollers for clamping the leading edge of each bank note delivered from the delivery roller and pulling each bank note therefrom; a control mechanism carried by a supporting shaft which rotatably carries the delivery roller for driving or stopping the delivery roller; sensor means disposed adjacent to the pull rollers for detecting the passage of each bank note; and an encoder carried by a shaft of one of the pull rollers; the pulling velocity of the pull rollers being substantially equal to the delivery velocity of the delivery roller, the delivery roller being stopped through the control mechanism while the number of pulses generated from the encoder is started to be counted when the passage of a bank note is detected by the sensor means, the delivery roller receiving a starting signal through the control mechanism when the number of the rotations of the pull rollers reaches a predetermined value to generate a predetermined number of pulses from the encoder.

2. A bank note dispenser as set forth in claim 1, wherein the control mechanism comprises a clutch mechanism for transmitting a rotational force to the delivery roller and a brake device for stopping the rotation of the delivery roller; the clutch mechanism and the brake device being operatively coupled to the sensor means and the encoder, the operations of the clutch mechanism and the brake device being controlled in response to the output signals from the sensor means and the encoder.

3. A bank note dispenser as set forth in claim 2, wherein the clutch mechanism comprises an electromagnetic clutch and the brake device comprises an electromagnetic brake.

4. A bank note dispenser as set forth in claim 1, wherein the control mechanism comprises a pulse motor which is started by the sensor means and driven for a time corresponding to a predetermined number of pulses generated from the encoder.

5. A bank note dispenser as set forth in claim 1, wherein the feed rollers and the delivery roller are connected with each other through belts, each of the feed rollers being an eccentric roller.

* * * * *